US007165504B1

(12) United States Patent
Miller

(10) Patent No.: US 7,165,504 B1
(45) Date of Patent: Jan. 23, 2007

(54) ANTENNA LINEAR EXTENSION AND RETRACTION APPARATUS FOR A SUBMERSIBLE DEVICE, AND METHOD OF USE

(75) Inventor: Grant M. Miller, Niantic, CT (US)

(73) Assignee: The United States of America as represented by the Secretary of the Navy., Washington, DC (US)

( * ) Notice: Subject to any disclaimer, the term of this patent is extended or adjusted under 35 U.S.C. 154(b) by 29 days.

(21) Appl. No.: 11/016,481

(22) Filed: Dec. 20, 2004

(51) Int. Cl.
*H01Q 1/34* (2006.01)
*H01Q 1/04* (2006.01)
*H01Q 1/08* (2006.01)
*B63G 8/38* (2006.01)

(52) U.S. Cl. ..... 114/328; 441/11; 441/33; 343/709; 343/883; 343/902

(58) Field of Classification Search ..... 114/326–329; 441/7–11, 20, 32, 33; 343/709–714, 883, 343/901, 902; 367/141; 116/27, 210, DIG. 8, 116/DIG. 9; 340/850
See application file for complete search history.

(56) References Cited

U.S. PATENT DOCUMENTS

| | | | | |
|---|---|---|---|---|
| 996,395 | A * | 6/1911 | Bailey | 116/27 |
| 1,557,049 | A * | 10/1925 | Hammond, Jr. | 343/709 |
| 2,646,504 | A * | 7/1953 | Gosline | 92/52 |
| 3,131,391 | A * | 4/1964 | Boswell et al. | 342/5 |
| 3,158,865 | A * | 11/1964 | McCorkle | 343/709 |
| 3,500,408 | A * | 3/1970 | Daughenbaugh | 342/10 |
| 3,500,429 | A * | 3/1970 | Milazzo et al. | 343/883 |
| 3,972,046 | A * | 7/1976 | Lombardi | 343/709 |
| 3,972,047 | A * | 7/1976 | Lombardi | 343/709 |
| 4,121,529 | A | 10/1978 | Smith et al. | |
| 4,266,500 | A | 5/1981 | Jurca | |
| 4,745,583 | A | 5/1988 | Motal | |
| 5,132,696 | A * | 7/1992 | Cobb | 343/709 |
| 5,319,376 | A | 6/1994 | Eninger | |
| 5,379,267 | A | 1/1995 | Sparks et al. | |
| 5,606,329 | A | 2/1997 | Ramotowski et al. | |
| 6,392,606 | B1 * | 5/2002 | French et al. | 343/709 |
| 6,845,728 | B1 * | 1/2005 | Horton | 114/244 |
| 6,870,508 | B1 * | 3/2005 | Rivera | 343/709 |
| 6,907,839 | B2 * | 6/2005 | Kruger et al. | 114/339 |
| 7,000,561 | B2 * | 2/2006 | Kruger et al. | 114/339 |

FOREIGN PATENT DOCUMENTS

DE 4440150 A1 * 5/1996

* cited by examiner

*Primary Examiner*—Ajay Vasudeva
(74) *Attorney, Agent, or Firm*—James M. Kasischke; Michael P. Stanley; Jean-Paul A. Nasser

(57) ABSTRACT

An antenna linear extension and retraction apparatus and method of use for a submersible device is provided. The apparatus includes a body having a cavity formed at an external surface. A bladder containing a core material is arranged within the cavity. The core material contracts and expands the bladder depending upon a pressure that surrounds the bladder. An antenna is operatively connected with the bladder and moves between a retracted position and a deployed position as the bladder contracts and expands.

8 Claims, 3 Drawing Sheets

ANTENNA LINEAR EXTENSION AND RETRACTION APPARATUS FOR A SUBMERSIBLE DEVICE, AND METHOD OF USE

STATEMENT OF GOVERNMENT INTEREST

The teachings described herein may be manufactured and used by or for the Government of the United States of America for governmental purposes without the payment of any royalties thereon or therefor.

BACKGROUND OF THE INVENTION

1. Field of the Invention

The present teachings relate to an antenna for a towed submersible device. More particularly, the present teachings relate to an apparatus and method for automatically raising and lowering an antenna from the body of a towed communications buoy.

2. Description of the Prior Art

As known in the art, communication buoys can be towed behind submarines by a deploying and retrieving cable. During operation and upon release from a submarine, known communication buoys are designed to rise to the surface of the sea. At the sea surface, the communication buoys deploy equipment, such as, an antenna that permits the submarine to carry-on radio communications with other, sea, land, and air-based communication systems, such as satellites.

When not in use, the communication buoys are retrieved and stowed in uniformly-shaped containers formed in the superstructure or pressure-hull of a submarine. Storing communications buoys within the superstructure or pressure-hull of a submarine protects the buoys and provides maximum submarine maneuverability. However, any portion of the deployed antenna that extends beyond the main body of the communications buoy must be retracted to permit efficient storage.

In the past, complicated electro-mechanical devices have been used to articulate the masts and antennas of communication buoys. For example, electric motors and pumps have been used for turning a jacking screw or to move a hydraulic ram to articulate an antenna. Such devices are large and heavy; thereby, requiring additional buoyancy and additional resources, such as electricity, to operate. In addition, these devices are difficult to seal or make pressure-tolerant to prevent fouling by organic and inorganic materials. Moreover, because communication buoys are expendable, the added cost of an electro-mechanical articulation device reduces their cost-effectiveness.

Furthermore, radio-frequency communications antennas when used with towed communication buoys suffer a degradation of performance at or near the surface of the sea. This degradation can be attributed to the fact that a seawater-atmospheric boundary presents an imperfect environment for operating antennas. The seawater-atmospheric boundary can be characterized as a non-uniform, a non-perfect conducting, and a non-free space ground plane. Moreover, seawater washing onto the antenna of a communications buoy can contribute to the degradation of antenna performance.

The imperfect seawater-atmospheric boundary can affect the antenna's electrical characteristics by dynamically changing the antenna's instantaneous electrical parameters resulting in a time-varying gain and pattern. Washing over seawater prevents the antenna from transmitting or receiving RF energy and can result in the receipt of system self-noise or erroneous information.

As a result of that which was described above, there exists a need to provide a lightweight, inexpensive, compact and simple apparatus for automatically raising and lowering an antenna from the body of a towed communications buoy. There also exists a need to provide such an apparatus that can reduce or eliminate the degradation of performance by raising the antenna the greatest extent possible from the seawater-atmospheric boundary. There still further exists a need for such an apparatus that is foul-resistant and sea-pressure tolerant.

SUMMARY OF THE INVENTION

The present teachings disclose an antenna linear extension and retraction apparatus for a submersible device in which the apparatus includes a body having a cavity formed therein. A bladder is arranged in the cavity and a core material is situated within the bladder. The core material is capable of contracting and expanding the bladder depending upon a pressure surrounding the bladder. An antenna is operatively connected with the bladder and the antenna retracts and extends from a deployed position as the bladder contracts and expands.

The present teachings also provide a submersible device comprising a body having an external surface. A cavity is formed in the external surface of the body and a bladder is arranged in the cavity. A core material is situated within the bladder and contracts and expands the bladder depending upon a pressure surrounding the bladder. An antenna is operatively connected with the bladder. The antenna retracts in and extends from the cavity between a retracted position and a deployed position as the bladder contracts and expands.

The present teachings also provide a method of retracting and extending an antenna of a submersible device. The method provides a cavity within an external surface of a body of the submersible device, provides a bladder containing a pressure-sensitive core material within the cavity, and provides an antenna in operative contact with the bladder. The method includes submerging the device at various depths to expose the antenna to various pressures that can contract and expand the bladder; thereby, causing the antenna to move between a retracted position and a deployed position.

By positioning an antenna by way of a pressure-sensitive bladder assembly as disclosed by the present teachings, the antenna linear extension and retraction apparatus and method according to various embodiments provides a lightweight, inexpensive, compact, and simple way of automatically raising and lowering an antenna from a submersible device. Moreover, the antenna linear extension and retraction apparatus and method provides improved performance by allowing the antenna to raise a great distance above the surface of the sea and by isolating the bladder from seawater.

Additional features and advantages of various embodiments will be set forth in part in the description that follows, and in part will be apparent from the description, or may be learned by practice of various embodiments. The objectives and other advantages of various embodiments will be realized and attained by means of the elements and combinations particularly pointed out in the description herein.

It is to be understood that both the foregoing general description and the following detailed description are exemplary and explanatory only, and are intended to provide an explanation of various embodiments of the present teachings.

DESCRIPTION OF TEE PREFERRED EMBODIMENTS

Figure 1:
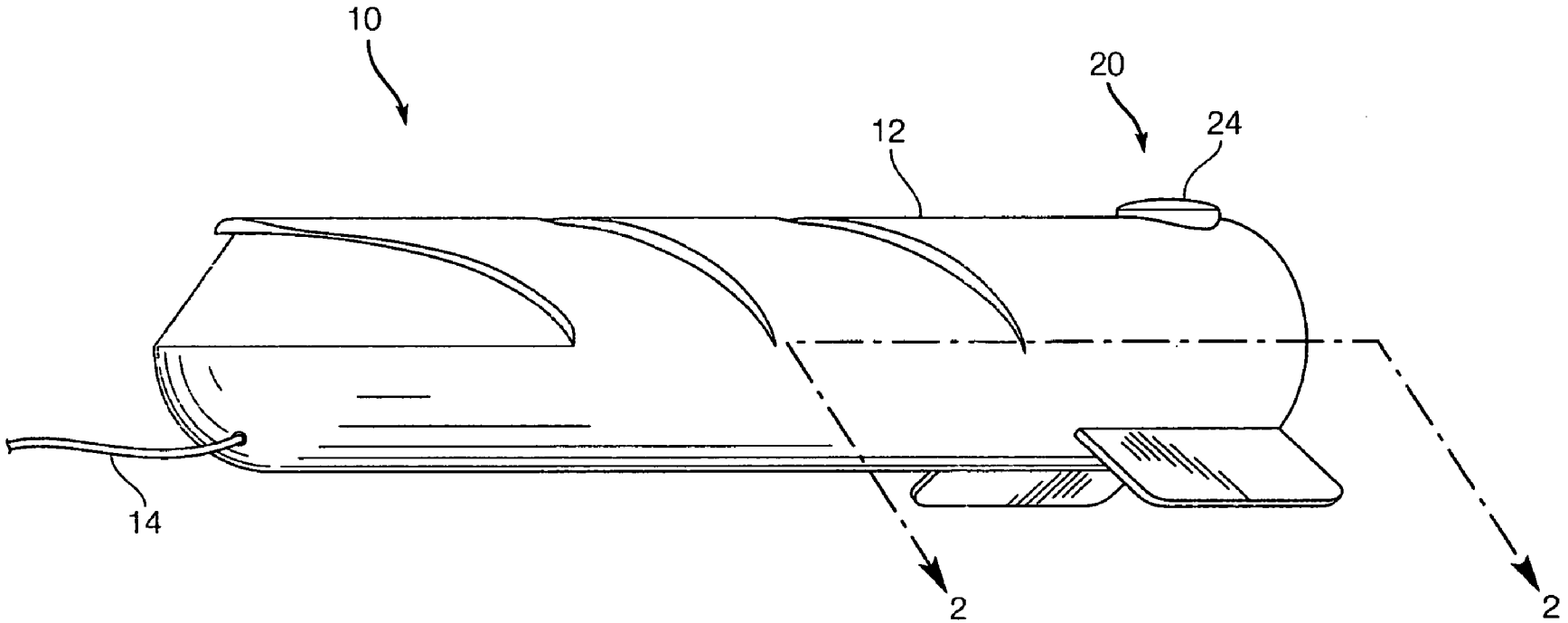
FIG. 1 is a perspective view of a submersible device incorporated with an antenna linear extension and retraction apparatus according to various embodiments.

Referring to FIG. 1, a submersible device 10 is shown incorporating an antenna linear extension and retraction apparatus 20 according to various embodiments. The antenna linear extension and retraction apparatus 20 is shown in a retracted state wherein a cover or cap 24 of the antenna linear extension and retraction apparatus 20 is arranged substantially flush with an exterior surface of a main body or housing 12 of the submersible device 10. The submersible device 10 can be a communications buoy capable of communicating with and being towed by a submarine by way of a tow-cable sub-assembly 14, as shown in FIG. 1. However, it is contemplated that the submersible device 10 could encompass any type of water-based, submersible device, such as, for example, an unmanned remote or autonomous vehicle, a projectile, dingy, float, missile, torpedo, or other device that can have a communications system incorporated therein.

Figure 2:
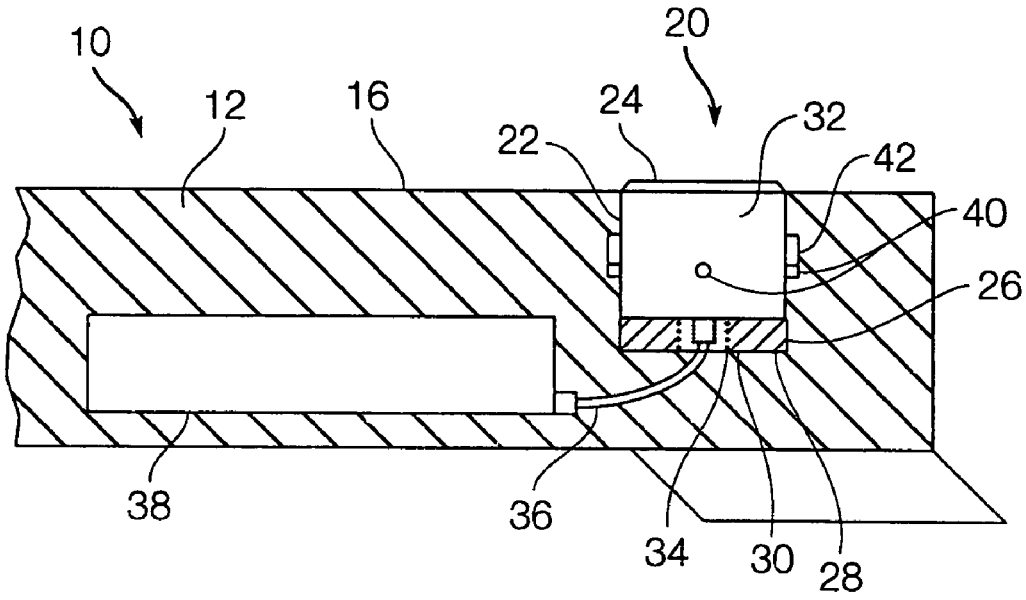
FIG. 2 is a side cross-sectional view of the submersible device of FIG. 1 showing the antenna linear extension and retraction apparatus in a retracted state with the view taken from reference line 2—2 of FIG. 1.

FIG. 2 illustrates the components of the antenna linear extension and retraction apparatus 20 according to various embodiments. The antenna linear extension and retraction apparatus 20 is shown in the rear of the submersible device 10 but can be arranged anywhere along the length of the main body 12 of the submersible device 10. The antenna linear extension and retraction apparatus 20 is housed in a cavity 22 formed at an external surface 16 of the main body 12. A bladder 26 filled with a pressure-sensitive core material 30 is arranged at a bottom surface 28 of the cavity 22. An antenna 32 is arranged in the cavity 22 and in a movable relationship with the bladder 26 such that the antenna 32 can be displaced with respect to the cavity 22 as the bladder 26 contracts and expands. The cap 24 can be arranged at a top portion of the antenna 32. The cap 24 can be arranged to fill a void formed in the main body 12 of the submersible device 10 created by the antenna linear extension and retraction apparatus 20.

Figure 3:
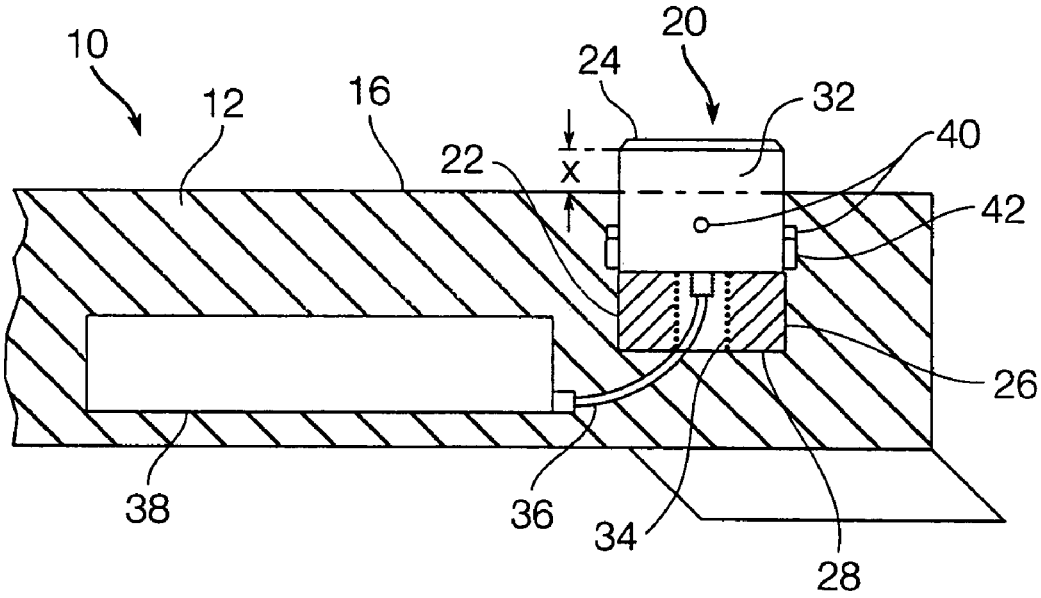
FIG. 3 is a side cross-sectional view of the submersible device showing the antenna linear extension and retraction apparatus in a deployed state.

When the submersible device 10 is deployed in an underwater environment, the pressure-sensitive core material 30 allows the bladder 26 to contract and expand as a function of forces acting on the bladder 26. In this manner, the bladder 26 can act as prime-mover, engine, or motor that can automatically position the antenna 32 between a retracted position and a deployed position. FIG. 2 shows the antenna linear extension and retraction apparatus 20 in a fully-retracted position where the bladder 26 is contracted and the cap 24 of the antenna 32 is substantially flush with the external surface 16 of the main body 12. In contrast, FIG. 3 shows the linear extension and retraction apparatus 20 in a fully-deployed position where the bladder 26 is expanded and the antenna 32 extends above the external surface 16 of the main body 12. In the deployed state of the antenna linear extension and retraction apparatus 20, the antenna 32 can operate to transmit and receive radio-frequency communications and relay them to a submerged platform, such as, for example, a submarine, that can be towing the submersible device 10.

During submersible operation of the device 10, the size of the bladder 26 can be influenced by various forces. For example, a top portion of the bladder 26 can be compressed by the weight of seawater acting on the antenna 32. A bottom portion of the bladder 26 can be compressed as the weight above the bladder 26 forces it against the bottom 28 of the cavity 22. As shown in FIGS. 2 and 3, the bladder 26 and antenna 32 can be arranged in the cavity 22 such that the bladder 26 is substantially isolated from seawater. The cavity 22 can form a non-pressure sealed or non-watertight compartment having a close-tolerance with the antenna 32 positioning therein. The cavity 22 and antenna 32 can have complementary cross-sectional shapes, such as, for example, circular, oval, square, rectangular, triangular, polygonal, and the like.

Referring again to FIGS. 2 and 3, one or more pins 40 can be connected with the antenna 32 and one or more slots 42 can be formed in the cavity 22. Each pin 40 can be arranged in a corresponding slot 42. The pins 40 and slots 42 can serve to guide the antenna 32 as the antenna positions in the cavity 22. The pins 40 and slots 42 can be arranged to provide stops at the fully retracted and deployed positions illustrated in FIGS. 2 and 3, respectively.

The bladder 26 can be made of a waterproof, pressure-tolerant, and/or resilient material. For example, the bladder 26 can be made of a rubber, such as neoprene. As shown in FIGS. 4–7, the bladder 26 can be constructed in the shape of a toroid encompassing a pass-thru axis 34. Referring to FIGS. 2 and 3, an antenna feed cable 36, such as, for example, a coiled RF antenna feed cable, can be arranged in the pass-thru axis 34 to connect the antenna 32 with an electronic control system 38 supported within the body 12.

Figure 4:
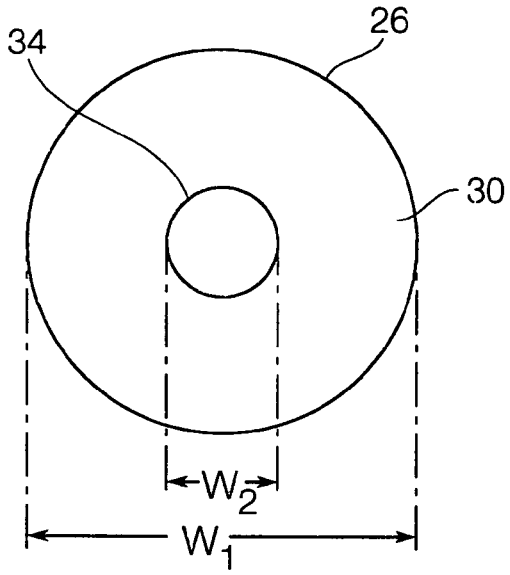
FIG. 4 is a top cross-sectional view of a toroidally-shaped bladder in a fully expanded state.
Figure 6:
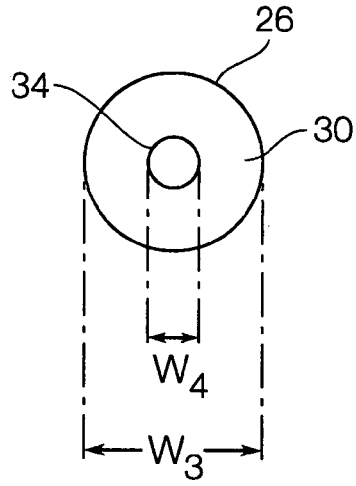
FIG. 6 is a cross-sectional top view of a toroidally-shaped bladder in a fully contracted state.
Figure 5:
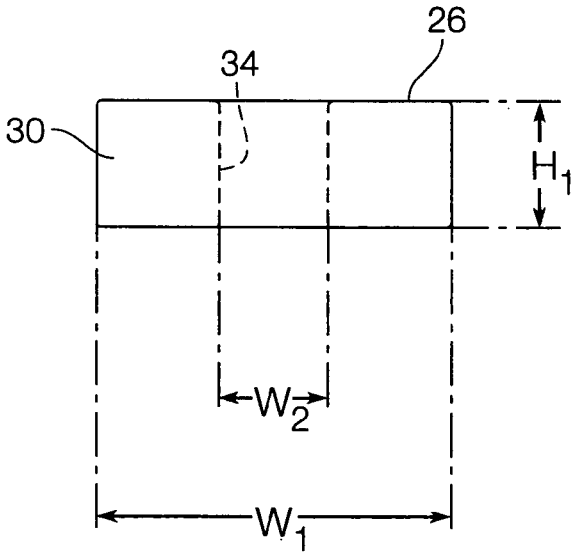
FIG. 5 is a cross-sectional side view of the bladder of FIG. 4.
Figure 7:
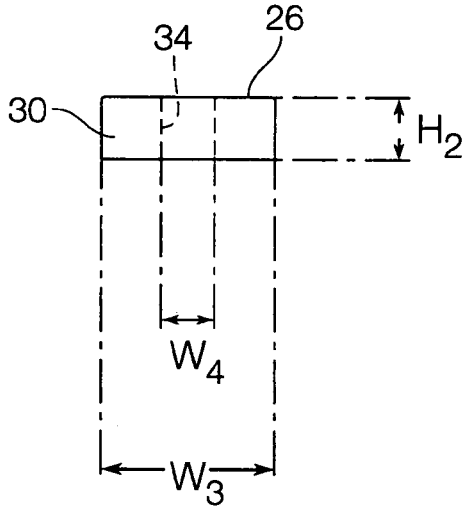
FIG. 7 is a cross-sectional side view of the bladder of FIG. 6.

FIGS. 4–7 illustrate the shape and dimensions of a bladder 26 having a generally toroidal shape. FIGS. 4 and 5 show the bladder 26 in a fully-expanded state, and FIGS. 6 and 7 show the bladder 26 in a fully-contracted shape.

Referring to FIGS. 4 and 5, a fully-expanded bladder 26 can have an outer diameter, $W_1$, that can range from about 3.5 inches to about 5.5 inches. The pass-thru axis 34 of the expanded bladder 26 can have a diameter, $W_2$, that can range from about 1.5 inches to about 2.5 inches. Referring to FIG. 5, the expanded bladder 26 can have a height, $H_1$, that can range from about 1.0 inches to about 3.0 inches.

Referring to FIGS. 6 and 7, a fully-contracted bladder 26 can have an outer diameter, $W_3$, that can range from about 1.5 inches to about 3.5 inches. The pass-thru axis 34 of the fully-expanded bladder 26 can have a diameter, $W_4$, that can range from about 0.5 inches to about 1.5 inches. Referring to FIG. 7, the fully-contracted bladder 26 can have a height, $H_2$, that can range from about 0.25 inches to about 0.5 inches.

Alternatively, the bladder 26 can be constructed in other sizes and shapes, such as, for example, a disc, plate, puck, and the like. Notwithstanding the specific shape of the bladder 26, the antenna feed cable 36 can be arranged to extend around or through the bladder 26 in order to allow the antenna 32 to communicate with the electronic control system 38.

An interior of the bladder 26 can be filled with a core material 30. The core material 30 can have characteristics that allow it, and in turn the bladder 26, to automatically contract and expand in response to ambient pressure. The core material 30 can be a flexible, compressible, and/or resilient material. The core material 30 can be designed to be substantially uncompressed when exposed to an ambient pressure of about 1 atm, corresponding to a pressure at or around sea level. The core material 30 can be designed to become substantially fully compressed as the ambient pressure increases to about 2 atm, corresponding to a depth of about 33 feet below sea level. The core material can be, for example, a dense, visco-elastic foam.

Accordingly, as the submersible device 10 incorporating the antenna linear extension and retraction apparatus 20 rises to the surface of the sea, the antenna linear extension and retraction apparatus can become exposed to atmospheric pressure, or a pressure of about 1 atm absolute. At atmospheric pressure, the core material 30 can be substantially uncompressed and the expanded bladder 26 can fully deploy the antenna 32 out beyond the external surface 16 of the submersible device 10, represented by the distance, X, as shown in FIG. 3. The distance, X, represents a full throw of movement of the antenna 32 out of the main body 12 and can correspond to a distance of up to about 6 inches. By raising the antenna 32 such a relatively large distance away from the seawater-atmospheric boundary, it is possible to reduce or substantially eliminate the degradation of performance of the antenna 32 caused by seawater and the imperfect seawater-atmospheric boundary.

As the submersible device 10 begins to submerge below the sea surface, such as, for example, when a towing submarine begins to dive deeper or begins to retrieve the submersible device 10, the pressure exerted by the seawater begins to compress the core material 30 thereby contracting the bladder 26. As the submersible device 10 is towed deeper and the pressure exerted by the sea water increases to about 2 atm, corresponding to a depth of about 33 feet below sea level, the bladder 26 can contract to such a degree that the antenna 32 fully retracts into the main body 12 of the submersible device 10, as shown in FIG. 2. In the fully-retracted condition of the antenna linear extension and retraction apparatus 20, the submersible device 10 can be stably towed at relatively high-speeds without experiencing additional drag loads. The relatively low drag makes it unnecessary to reinforce a tow-point of a towing body, such as, for example, a tow-point on the sail of a submarine. Moreover, the retracted antenna linear extension and retraction apparatus 20 places the submersible device 10 in a condition that allows it to be stowed in a location within the superstructure of the towing submarine.

The antenna linear extension and retraction apparatus 20 allows an antenna 32 to be automatically fully-deployed when a submersible device 10 is at the surface of the sea and to automatically stow within the submersible device 10 as it submerges a set distance below the surface. The linear extension and retraction performed by the antenna linear extension and retraction apparatus 20 is considered automatic because it relies on variable water pressure to retract and deploy the antenna 32 without user intervention. The antenna linear extension and retraction apparatus 20 is simple and lightweight, and does not rely on electricity or a complicated and heavy electro-mechanical mechanism, such as a motor and jacking-screw assembly, to position the antenna 32. Moreover, the bladder 26 of the antenna linear extension and retraction apparatus 20 is isolated from seawater substantially eliminating the effects of fouling by seawater.

Those skilled in the art can appreciate from the foregoing description that the present teachings can be implemented in a variety of forms. Therefore, while these teachings have been described in connection with particular embodiments and examples thereof, the true scope of the present teachings should not be so limited. Various changes and modifications may be made without departing from the scope of the teachings herein.

What is claimed is:

1. An antenna linear extension and retraction apparatus for a submersible device, said apparatus comprising:
- a body including a cavity formed therein;
- a bladder arranged in said cavity wherein said bladder is substantially in the shape of a toroid;
- a core material arranged within said bladder and capable of contracting and expanding said bladder depending upon a pressure surrounding said bladder; and
- an antenna operatively connected with said bladder and capable of positioning between a retracted position and a deployed position in reaction to said bladder contracting and expanding.

2. An antenna linear extension and retraction apparatus for a submersible device, said apparatus comprising:
- a body including a cavity formed therein;
- a bladder arranged in said cavity;
- a core material arranged within said bladder and capable of contracting and expanding said bladder depending upon a pressure surrounding said bladder wherein said core material is made of a visco-elastic foam; and
- an antenna operatively connected with said bladder and capable of positioning between a retracted position and a deployed position in reaction to said bladder contracting and expanding.

3. An antenna linear extension and retraction apparatus for a submersible device, said apparatus comprising:
- a body including a cavity formed therein;
- a bladder arranged in said cavity;
- a core material arranged within said bladder and capable of contracting and expanding said bladder depending upon a pressure surrounding said bladder;
- an antenna operatively connected with said bladder and capable of positioning between a retracted position and a deployed position in reaction to said bladder contracting and expanding;
- a plurality of slots arranged in said cavity; and
- a plurality of pins operatively connected with said antenna, each of said plurality of pins being arranged in a corresponding slot in said cavity to guide said antenna as said antenna positions between the retracted position and the deployed position.

4. A submersible device comprising:
- a body with an external surface;
- a cavity formed in the external surface;
- a bladder arranged in said cavity wherein said bladder is the shape of a toroid encompassing a pass-thru axis;

a core material arranged within said bladder, said core material capable of contracting and expanding said bladder depending upon a pressure surrounding said bladder; and an antenna operatively connected with said bladder and capable of positioning in said cavity between a retracted position and a deployed position as said bladder contracts and expands.

5. The submersible device in accordance with claim 4, further comprising an antenna feed cable connected to said antenna by said pass-thru axis.

6. The submersible device in accordance with claim 5, further comprising a control unit supported within said body, with said control unit connected to said antenna with said antenna feed cable.

7. A submersible device comprising:

a body with an external surface;

a cavity formed in the external surface;

a bladder arranged in said cavity;

a core material arranged within said bladder, said core material capable of contracting and expanding said bladder depending upon a pressure surrounding said bladder wherein said core material is made of a visco-elastic foam; and an antenna operatively connected with said bladder and capable of positioning in said cavity between a retracted position and a deployed position as said bladder contracts and expands.

8. A submersible device comprising:

a body with an external surface;

a cavity formed in the external surface;

a bladder arranged in said cavity;

a core material arranged within said bladder, said core material capable of contracting and expanding said bladder depending upon a pressure surrounding said bladder;

an antenna operatively connected with said bladder and capable of positioning in said cavity between a retracted position and a deployed position as said bladder contracts and expands;

a plurality of slots arranged in said cavity; and a plurality of pins operatively connected with said antenna, each of said plurality of pins arranged in a corresponding slot in said cavity to guide said antenna as said antenna positions between the retracted position and the deployed position.

* * * * *